United States Patent [19]

Swayze et al.

[11] Patent Number: 5,054,745

[45] Date of Patent: Oct. 8, 1991

[54] AUXILIARY WINCH FOR ALL TERRAIN VEHICLE

[76] Inventors: Frank A. Swayze, 1807 St. Joseph Pl., Monroe, La. 71201; Irvin R. Bourell, 344 Ragland Rd., Monroe, La. 71202

[21] Appl. No.: 456,959

[22] Filed: Dec. 26, 1989

[51] Int. Cl.[5] ..... B66D 1/36

[52] U.S. Cl. ..... 254/325; 254/280; 254/328; 242/95

[58] Field of Search ..... 242/86.5 R, 94, 95, 242/117; 254/279, 280, 281, 282, 323, 325, 326, 327, 328, 266; 280/755

[56] References Cited

U.S. PATENT DOCUMENTS

| | | | |
|---|---|---|---|
| 25,070 | 8/1859 | Wills | 254/323 |
| 613,138 | 10/1898 | Gempeler | 242/86.5 R |
| 629,115 | 7/1899 | Turney | 242/117 |
| 685,759 | 11/1901 | Grinder | 242/95 |
| 717,232 | 12/1902 | Lubin | 254/325 |
| 1,197,072 | 9/1916 | Simmons | 242/95 |
| 1,218,898 | 3/1917 | Roades | 242/117 |
| 1,270,104 | 6/1918 | Benton et al. | 180/7.5 |
| 1,401,263 | 12/1921 | Ludescher | 254/328 |
| 1,449,181 | 3/1923 | Holmes | 242/86.51 |
| 1,463,022 | 7/1923 | Sepelyak | 242/95 |
| 1,528,058 | 3/1925 | Hobson | 242/95 |
| 1,630,800 | 5/1927 | Page | 212/172 |
| 1,850,976 | 3/1932 | Greve | 242/117 |
| 2,240,570 | 5/1941 | Oesterheld | 242/95 |
| 2,588,721 | 3/1952 | Heller | 254/282 |
| 2,737,355 | 3/1956 | Tourand | 242/95 |
| 3,099,416 | 7/1963 | Wright | 242/95 |
| 3,843,093 | 10/1974 | Thompson et al. | 254/325 |
| 3,917,228 | 11/1975 | Blum | 242/95 |
| 4,135,681 | 1/1979 | Cooper | 242/95 |
| 4,291,847 | 9/1981 | Gilbert | 242/95 |
| 4,522,420 | 6/1985 | Hannappel | 280/755 |
| 4,568,036 | 2/1986 | Kearney | 254/323 |
| 4,742,971 | 5/1988 | Wallace | 242/95 |
| 4,778,126 | 10/1988 | Spann, Jr. | 254/325 |

FOREIGN PATENT DOCUMENTS

| | | | |
|---|---|---|---|
| 127895 | 6/1948 | Australia | 242/117 |
| 974972 | 9/1975 | Canada | 254/325 |

*Primary Examiner*—Daniel P. Stodola
*Assistant Examiner*—Charles T. Riggs, Jr.
*Attorney, Agent, or Firm*—John M. Harrison

[57] ABSTRACT

An auxiliary winch for mounting on the drive axle of an all terrain vehicle and operating by rotation of the drive axle to remove the all terrain vehicle from a stuck or bogged condition. In a preferred embodiment, the auxiliary winch is characterized by a split shaft fitting having matching split shaft halves for fixed retrofitting to the drive axle of the all terrain vehicle and a split reel characterized by a pair of matching split reel halves which mount on the split shaft fitting in normally rotatable relationship. A pair of wing nut bolts are used to couple the split shaft fitting to the split reel. One end of a winch line is anchored to the split reel, the winch line is extended through a pulley mounted on the vehicle frame above and in alignment with the split reel and the opposite end of the winch line is secured to a tree, stump or other fixed object when the all terrain vehicle is stuck or bogged. Removal of the all terrain vehicle from the stuck or bogged condition is then effected by placing the all terrain vehicle in gear and allowing the winch line to wind on the split reel.

6 Claims, 1 Drawing Sheet

AUXILIARY WINCH FOR ALL TERRAIN VEHICLE

BACKGROUND OF THE INVENTION

1. Field of the Invention

This invention relates to all terrain vehicles and more particularly, to an auxiliary winch for mounting on the drive axle of an all terrain vehicle for removing the all terrain vehicle from a stuck or bogged condition. In a preferred embodiment, the auxiliary winch includes a split shaft fitting for fixed or removable mounting on the drive axle of the all terrain vehicle, a split reel adapted to mount on the split shaft fitting, a pulley attached by means of a swivel to the frame of the vehicle above and in alignment with the split reel and a pair of wing head bolts for coupling the split reel to the split shaft fitting. Alternatively, the wing head bolts can be removed to allow the split shaft fitting to freely rotate with the drive axle and with respect to the stationary split reel when the all terrain vehicle is in normal operating mode. When the all terrain vehicle becomes bogged or stuck, the split reel is normally coupled to, and caused to rotate with, the split shaft fitting as the pair of wing-head bolts extend through spaced apertures in the split shaft fitting and thread into corresponding threaded apertures in the split reel. A winch line is extended through the pulley and attached to the split reel, with one end of the winch line anchored to the split reel and the opposite end extending from the split reel around the pulley for attachment to a tree, stump or other fixed object, in order to remove the all terrain vehicle from the bogged or stuck condition by operation of the drive axle and auxiliary winch. Alternatively, under circumstances where the all terrain vehicle is positioned such that a stump or other fixed object is located directly in alignment with the split reel component of the auxiliary winch, the winch line may be extended directly from the split reel to the fixed object without using the pulley, in order to free the all terrain vehicle. In a most preferred embodiment of the invention, the split shaft fitting includes a pair of matching split shaft halves which are bolted to the all terrain vehicle axle, while the split reel also includes a pair of split reel halves adapted to rotatably mount on the split shaft fitting by means of allen bolts.

In recent years, the development of four-wheel all terrain vehicles has revolutionized hunting and fishing, as well as many other outdoor activities Previously relatively inaccessible areas are now open to the hunter, fishermen and outdoorsmen who use these all terrain vehicles, which are capable of traversing both mountainous and boggy terrain, in both two and four-wheel drive mode. However, like its larger four-wheel drive vehicle counterpart, the all terrain vehicle is susceptible to bogging and sticking in exceptionally muddy, snow covered, icy, sandy and boggy areas and although the all terrain vehicle is relatively light in weight, it can become stuck or bogged to the extent that one or two hunters or operators cannot remove it. Accordingly, there exists a need for a simple winch device which is carried by the all terrain vehicle and may be quickly and easily implemented to remove the all terrain vehicle from a bogged or stuck condition.

DESCRIPTION OF THE PRIOR ART

An early device for removing a vehicle from a stuck or bogged condition is detailed in U.S. Pat. No. 1,197,072, dated Sept. 5, 1916, to F. Simmons. The "Self Pulling Attachment for Motor Cars" includes a drum adapted for mounting on the rear wheel of the vehicle, with a winch line wound on the drum for extension from the drum through a pulley attached to a fixed object spaced from the vehicle and the free end of the winch line then secured to the front axle of the vehicle. Operation of the driven rear axle causes the winch line to wind on the drum and remove the vehicle from the stuck or bogged condition. An "Automobile Puller" is detailed in U.S. Pat. No. 1,270,104, dated June 18, 1918, to H. C. Benton and J. R. Vest. The automobile puller is mounted on the front end of an automobile and includes a drum fitted with a winch cable and having a gear mounted on one edge thereof for engaging a ratchet assembly. Manual rotation of the gear and drum winds the winch cable on the drum, to remove the vehicle from a bogged or stuck condition when the free end of the winch line is attached to a fixed object. A "Pulling Attachment for Motor Vehicles" is detailed in U.S. Pat. No. 1,401,263, dated Dec. 27, 1921, to E. Ludescher. The Ludescher pulling attachment includes a drum provided with a winch cable thereon, which drum is secured to a power take-off mechanism provided in a vehicle. Attachment of the free end of the winch cable to a fixed object such as a stump or a tree and operation of the power take-off assembly to wind the cable on the drum, removes the vehicle from a stuck or bogged condition. A similar device is detailed in U.S. Pat. No. 1,463,022, dated July 24, 1923, to M. Sepelyak. The "Draft Appliance for Automobiles" includes a drum secured to the rear wheel of a vehicle, a winch line wrapped on the drum, with the free end of the winch line extending to a first pulley attached to the midpoint of the vehicle and to a second pulley attached to a fixed object and then through a third pulley attached to the front end of the vehicle and back to the second pulley attached to the fixed object. Operation of the rear wheel winds the winch line on the drum and through the system of pulleys to extract the vehicle from a bogged or stuck condition. A similar "Device for Extracating Mud-Stalled Vehicles" is detailed in U.S. Pat. No. 1,528,058, dated Mar. 3, 1925, to B. D. Hobson. Still another variation on this same design is noted in U.S. Pat. No. 2,240,570, dated May 6, 1941, to K. O. Oesterheld. A similar "Emergency Traction Device" is detailed in U.S. Pat. No. 2,737,355, dated Mar. 6, 1956, to D. P. Tourand. U.S. Pat. No. 3,917,228, dated Nov. 4, 1975, to Julius A. Blum, details a "Method of Forming a Winch Assembly Upon a Power-Driven Vehicle and Such Assembly". The assembly includes two or more bar members threaded at one end for mounting on the vehicle wheel in place of the vehicle wheel retaining nuts or bolts and a unitary, fixed and preferably annular support means insertable between the bar members to brace and strengthen the bar members when a cable is wound thereon. The compressive forces of the cable serve to further secure the support means, and the bar members and support means are conveniently assembled upon the vehicle wheel to form a reel structure fixed to the wheel. Accordingly, upon rotation, the wheel functions as a winch and when not in use, the winch assembly may be conveniently disassembled into the component parts for storage. A "Winch Attachment for Vehicle Wheels" is detailed in U.S. Pat. No. 4,135,681, dated Jan. 23, 1979, to Wayne F. Cooper. The winch is constructed for removable attachment to the driving wheel of a motor vehicle by means of the vehicle lug bolts. The winch includes a hollow drum with flanges on each end, the inner one of the flanges having holes to receive the lug bolts of the vehicle wheel. The drum is also provided with holes formed directly opposite each of the lug bolt receiving holes, to accommodate the head of a wrench for tightening and loosening the lug bolts. The outer flange also has holes aligned with the lug bolt-receiving holes so that the wrench can pass through these holes in the outer flange for attaching and removing the winch to and from the vehicle wheel. The outer flange has an additional hole formed therein to facilitate attachment of a cable or rope for use with the winch. A "Winch Means" is detailed in U.S. Pat. No. 4,291,847, dated Sept. 29, 1981, to James C. Gilbert. The device includes a spool-like member for removable attachment to the drive wheels of the vehicle. One end of a flexible cable is attached to the spool-like member and the opposite end of the cable is secured to a fixed object such as a tree or a rock. Rotation of the drive wheels causes the cable to wind around the spool-like member and the vehicle to be drawn toward the fixed object. The spool-like member can be removed from the drive wheels regardless of whether the cable is fully wound on the spool-like member. The drive wheels can also be removed from the vehicle without removing the spool-like member from the drive wheels. U.S. Pat. No. 4,568,036, dated Feb. 4, 1986, to Morris J. Kearney, details a "Wheel-Operated Winch". The wheel-operated winch includes a cylindrically-shaped cable drum divided by spaced flanges which define a cable seat and a drum base extending from the cable drum and having base tabs for mounting to the base plate, which is welded to the wheel of an automobile. A cable is wound on the cable seat and in operation, the free end of the cable is attached to a point of anchor and the vehicle wheel is rotated to wind the cable on the cable drum and extract the vehicle from mud, snow, sand or ice. As a second element in the assembly, a cable guide is attached to the bumper of the vehicle and the cable is extended through a guide tube in the cable guide from the drum to the point of attachment. An optional third element in the wheel-operated winch assembly is a cable anchor characterized by a shaft having an earth auger at one end and an anchor plate and shaft eye at the opposite end, for securing the cable when no other point of anchor is available. U.S. Pat. No. 4,742,971, dated May 10, 1988, to John W. Wallace, et al, details an "Attachment Winch for Vehicle Wheels". The device includes multiple attachable brackets having an elongated body and first and second ends perpendicular to the body. The first ends have a first opening sized to fit over a plurality of lug sizes and secured to the lug by a lug nut and the second ends have a second opening. A plate has a plurality of holes positioned radially and circumferentially for alignment with the lugs of various vehicles having lugs of different radial and circumferential positions. Multiple nuts and bolts secure the second ends to the plate. A circular support core may be inserted between the inside of the brackets for strength and the lined guide ring may be attached to the vehicle for aligning a line connected to the brackets perpendicular to the brackets. A "Wheeled Vehicle Winch Assembly" is detailed in U.S. Pat. No. 4,778,126, dated Oct. 18, 1988, to C. D. Spann, Jr. The winch assembly includes a first hub member fixedly attached to a drive wheel of a vehicle, a reel member fixedly attached to the first hub member, a cable having one end attached to the reel member and having another reel end fixedly attached relative to an anchor, a second hub member fixedly attached to a non-drive wheel of the vehicle and a guide attached to the second hub member and guiding the cable between the reel member and the anchor. U.S. Pat. No. 25,070, dated Aug. 9, 1859, to E. Wills; U.S. Pat. No. 1,630,800, dated May 31, 1927, to G. W. Page; U.S. Pat. No. 1,449,181, dated Mar. 20, 1923, to M. P. Holmes; U.S. Pat. No. 2,588,721, dated Mar. 11, 1952, to J. Heller; and U.S. Pat. No. 4,522,420, dated June 11, 1985, to G. J. Hannappel detail various techniques for using axle-mounted gears or drums or the axle itself for powering purposes.

It is an object of this invention to provide an auxiliary winch for removing a vehicle from a stuck or bogged condition, which winch includes a shaft fitting mounted on the drive axle of the vehicle and a reel normally rotatably mounted on the shaft fitting and adapted to receive a winch line for attachment to a fixed object and removal of the vehicle from a bogged or stuck condition by coupling the reel to the shaft fitting and operation of the drive axle.

Another object of this invention is to provide an auxiliary winch for an all terrain vehicle, which winch is characterized by a shaft fitting for fixed or removable mounting on the drive axle of an all terrain vehicle, a reel normally coupled to the shaft fitting, a pulley suspended from the vehicle frame in alignment with the reel and a winch line adapted for extension around the pulley and attachment to the reel and to a fixed object, for removal of the all terrain vehicle from a bogged or stuck condition responsive to operating the drive axle.

Still another object of this invention is to provide an auxiliary winch for removing all terrain vehicles from water, mud, snow, ice or sand, which auxiliary winch is characterized by a split shaft fitting adapted for mounting on the drive axle of the all terrain vehicle, a split take-up reel designed for attachment to the split shaft fitting by means of removable wing head bolts in normally non-rotatable relationship, a pulley mounted by means of a swivel to the frame of the vehicle above and in alignment with the split take-up reel and a winch cable having one end extended around the pulley and fixedly attached to the split take-up reel and the opposite end extendible from the pulley for securing to a fixed object and removing the all terrain vehicle from a bogged or stuck condition responsive to operation of the drive axle.

A still further object of this invention is to provide a new and improved auxiliary winch for mounting on the drive axle of an all terrain vehicle having an open axle shaft and removing the all terrain vehicle from a bogged or stuck location. The auxiliary winch is characterized in a preferred embodiment by a split shaft fitting mounted on the drive axle of the all terrain vehicle, a split reel normally rotatably secured to the split shaft fitting, wherein the split shaft fitting may rotate with the drive axle and with respect to the split reel and the split reel is selectively fixed with respect to the split shaft fitting by insertion of a pair of wing head bolts through the split shaft fitting into the split reel. A winch cable is wound on the split reel, with one end fixedly attached to the split reel and the opposite end extendible from the split reel for attachment to a fixed object aligned with the auxiliary winch, wherein the all terrain vehicle can be removed from a bogged or stuck condition by operation of the drive axle and winding the winch line on the split reel after coupling the split shaft fitting to the split reel with the wing head bolts. Alternatively, under circumstances where the auxiliary winch is not aligned with the fixed object, the winch line may be extended around a pulley which is mounted on the frame of the vehicle by means of a swivel, and the winch line then attached to the split reel and the fixed object.

SUMMARY OF THE INVENTION

These and other objects of the invention are provided in a new and improved auxiliary winch adapted for mounting on a drive axle of an all terrain vehicle for removing the all terrain vehicle from mud, snow, sand or ice, which auxiliary winch includes a round split shaft fitting having matching split shaft halves for mounting on the drive axle by means of allen bolts, a split reel characterized by a pair of matching split reel halves for normally rotatably seating over the split shaft fitting, a pair of wing nut bolts inserted through apertures in the split shaft fitting and threaded into the split reel for removably coupling the split reel to the split shaft fitting, a pulley secured by means of a swivel to the vehicle frame above and in alignment with the split reel and a winch line having one end anchored to the split reel and the opposite end of the winch line adapted for extension from the split reel around the pulley and securing to a fixed object, wherein the all terrain axle of the all terrain vehicle toward the fixed object and thereby winding the winch line on the split reel to free the all terrain vehicle.

BRIEF DESCRIPTION OF THE DRAWING

The invention will be better understood by reference to the accompanying drawing wherein.

DESCRIPTION OF THE PREFERRED EMBODIMENTS

Figure 1:
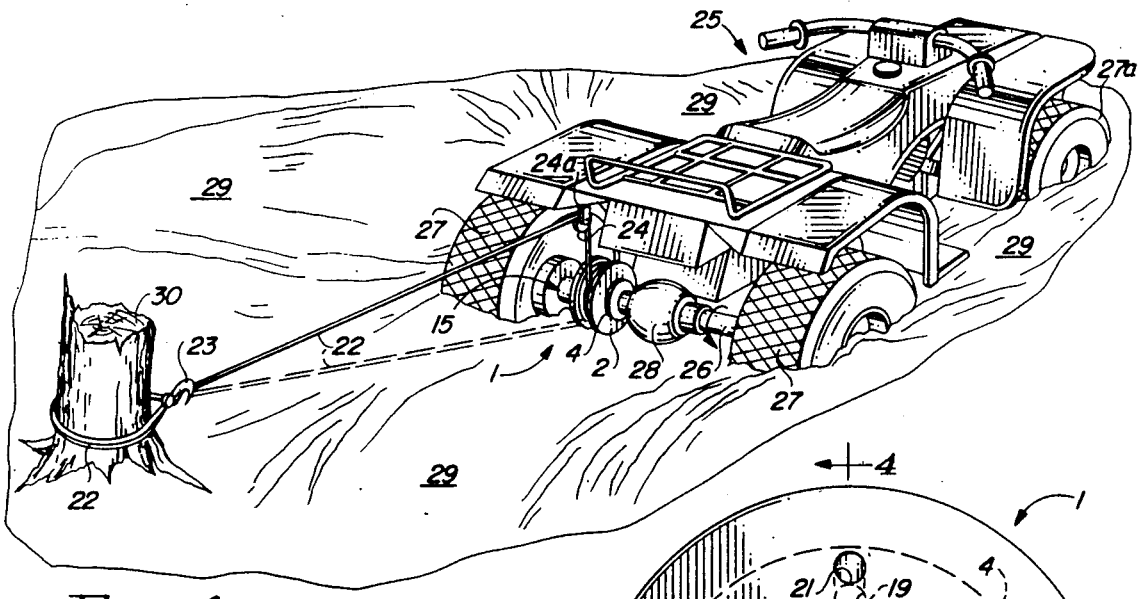
FIG. 1 is a perspective view of the auxiliary winch secured to the drive axle of an all terrain vehicle for removing the all terrain vehicle from a stuck or bogged condition.

Referring initially to FIG. 1 of the drawing, the auxiliary winch of this invention is generally illustrated by reference numeral 1. The auxiliary winch 1 is mounted on the drive axle 26 of an all terrain vehicle 25, the rear tires 27 and front tires 27*a* of which are bogged in the mud 29. A winch line 22 extends from the split reel 15 element of the auxiliary winch 1 around a pulley 24, mounted by means of a pulley swivel 24*a*, to the all terrain vehicle 25. The free end of the winch line 22 is provided with an optional winch line hook 23, for securing the winch line 22 to a stump 30. Alternatively, the winch line 22 can be tied to the stump 30. Removal of the all terrain vehicle 25 from the mud 29 is effected by operation of the drive axle 26 and the rear tires 27 in reverse by means of the differential 28, to rotate the split reel 15 in the direction of the arrow, wind the winch line 22 around the pulley 24 on the split reel 15 and free the all terrain vehicle 25. Alternatively, under circumstances where the auxiliary winch 1 is aligned with the stump 30 or other fixed object, the winch line 22 can be extended directly from the split reel 15 to the stump 30, as illustrated in phantom.

Figure 3:
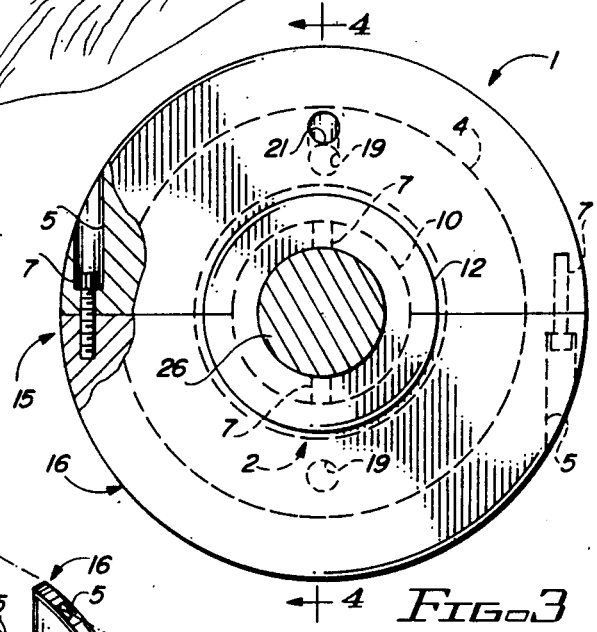
FIG. 3 is a plan view, partially in section, of the left side of the auxiliary winch illustrated in FIG. 1.
Figure 2:
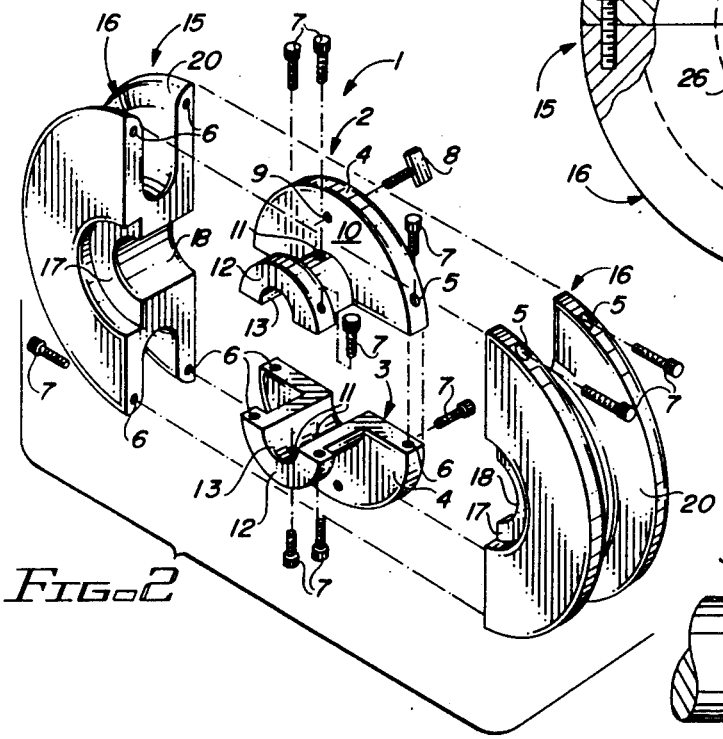
FIG. 2 is an exploded view of a preferred embodiment of the auxiliary winch illustrated in FIG. 1.

Referring now to FIGS. 2 and 3 of the drawing, in a preferred embodiment of the invention the auxiliary winch 1 is characterized by a split shaft fitting 2, defined by a pair of matching split shaft halves 3. Each of the split shaft halves 3 is further characterized by a matching large flange 4 and small flange 12, connected by a split shaft neck 10, which is shaped to define a semicircular axle seat 13. Both the large flange 4 and the small flange 12 of one of the split shaft halves 3 include spaced, unthreaded flange bolt receptacles 5 and threaded flange bolt receptacles 6 are provided in the large flange 4 and the small flange 12 of the opposite ones of the split shaft halves 3, respectively. Allen bolts 7 are designed to register with the unthreaded flange bolt receptacles 5 and thread into the threaded flange bolt receptacles 6, in order to removably secure the split shaft halves 3 together, with each semicircular axle seat 13 engaging the drive axle 26 of the all terrain vehicle 5, as illustrated in FIG. 3. Additional allen bolts 7 are designed to threadably engage corresponding threaded neck bolt receptacles 11, provided in the split shaft neck 10 of each of the split shaft halves 3, in order to securely, yet removably, seat the split shaft fitting 2 on the drive axle 26.

Figure 4:
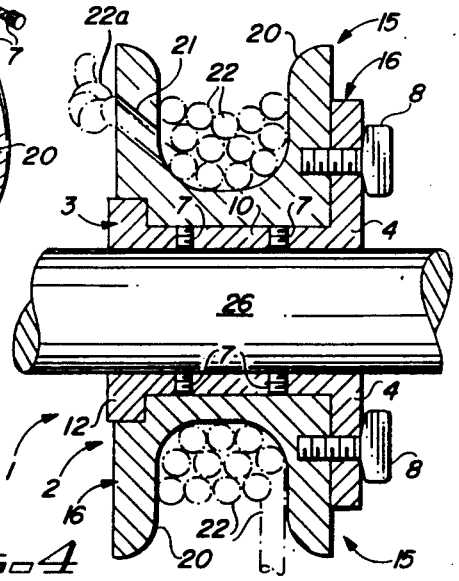
FIG. 4 is a sectional view taken along line 3—3 of the auxiliary winch illustrated in FIG. 3.

It will be appreciated from a consideration of FIGS. 1–4 of the drawing that the split reel 15 is normally seated on the split shaft fitting 2 such that the split shaft fitting 2 can rotate with the drive axle 26 and with respect to the split reel 15. Such free rotation is facilitated, since the split reel 15 is characterized by a pair of matching split reel halves 16, each of which is provided with a small flange seat 17, for accommodating the small flange 12 of the split shaft fitting 2 and a split shaft neck seat 18, for engaging the split shaft neck 10 of the split shaft fitting 2. Accordingly, when the split reel 15 is assembled on the split shaft fitting 2 as illustrated in FIGS. 3 and 4 and when the winch line 22 is wound on the split reel 15 and the optional winch line hook 23, illustrated in FIG. 1, is engaged with a frame member of the all terrain vehicle 25 in non-functional configuration for storage purposes, the split shaft fitting 2 will rotate with the drive axle 26 with respect to the split reel 15. However, rotation of the split shaft fitting 2 with respect to the split reel 15 is selectively prevented when the all terrain vehicle 25 is stuck or bogged, by inserting a pair of wing head bolts 8 in the large flange bolt receptacles 9, spaced in the large flange 4 of the split shaft fitting 2 and threadably engaging the ends of the wing head bolts 8 in corresponding, aligned threaded wing head bolt apertures 19, located in the split reel halves 16, as illustrated in phantom in FIG. 3. Consequently, it is understood that when the wing head bolts 8 are so inserted, the split reel 15 is coupled to, and rotates in concert with, the split shaft fitting 2 on the drive axle 26 of the all terrain vehicle 25 when the drive axle 26 is, in turn, rotated with the rear tires 27, responsive to operation of the differential 28 in the all terrain vehicle 25, as described above with respect to FIG. 1.

Although the winch line 22 may be wound on the split reel 15 when the auxiliary winch 1 is mounted on the drive axle 26 and the split shaft fitting 2 is allowed to rotate with the drive axle 26 and with respect to the split reel 15, in a most preferred embodiment of the invention the winch line 22 is not wound on the split reel 15 until the all terrain vehicle 25 is bogged or stuck. This allows the wing head bolts to remain normally in place, locking the split reel 15 to the split shaft fitting 2. When the all terrain vehicle 25 is stuck, one end of a winch line 22 is run through the pulley 24 and through the winch line anchor port 21, where it is tied with a knot 22*a*. The opposite end of the winch line 22 is then secured to a fixed object such as the stump 30 and the all terrain vehicle 25 is operated to wind the winch line 22 on the split reel 15 and free the all terrain vehicle 25. This procedure eliminates the necessity for inserting the wing head bolts 8 into the large flange bolt receptacles 9 and threaded wing head bolt receptacles 19, which receptacles might be plugged with mud, dirt, sand or ice, since the wing head bolts 8 are already in place.

Referring again to FIGS. 2 and 4 of the drawing, in a preferred embodiment of the invention a winch line groove 20 is provided in the split reel 15, in order to accommodate the winch line 22. One end of the winch line 22 extends through the winch line anchor port 21, provided in one side of the split reel half 16, and the knot 22*a* is provided in the anchored end of the winch line 22, in order to secure the winch line 22 in coiled position in the winch line groove 20 or in an uncoiled configuration, as noted above. The opposite end of the winch line 22 may be fitted with a winch line hook 23, which may be attached to a desired point on the frame of the all terrain vehicle 25 for storage when the all terrain vehicle 25 is in normal operating configuration and the winch line 22 is pre-wound on the split reel 15, further as described above.

Accordingly, referring again to the drawing and as described above, in a most preferred embodiment, the wing head bolts 8 are normally in place, locking the split shaft fitting 2 to the split reel 15. Consequently, when the all terrain vehicle becomes stuck, one end of a winch line 22 such as a ⅜ inch nylon rope, is extended around the pulley 24 and through the winch line anchor port 21, where it secured by the knot 22*a*. The opposite end of the winch line 24 is secured to the stump 30 or other fixed object and the all terrain vehicle 25 is operated to wind the winch line 22 evenly on the split reel 15, by operation of the pulley 24. Alternatively, the all terrain vehicle 25 may be normally operated with the wing head bolts 8 removed from engagement with the split reel 15 and the split shaft 2, in order to facilitate rotation of the split shaft fitting 2 freely with the drive axle 26 and with the split reel 15 in non-rotating configuration, wherein the winch line hook 23 of the winch line 22 may be hooked on a frame member of the all terrain vehicle 25. Under these conditions, when the all terrain vehicle 25 becomes stuck or bogged as illustrated in FIG. 1, the winch line hook 23 is first disengaged from its stored position on the frame of the all terrain vehicle 25 and extended through the pulley 24 or directly outwardly of the auxiliary winch 1 by free rotation of the split reel 15 with respect to the split shaft fitting 2, to a stump 30 or other fixed object such as a tree or the like, where the winch line 22 is secured to the stump 30 by the winch line hook 23, as further illustrated in FIG. 1. The split reel 15 is then rotatably adjusted on the split shaft fitting 2 to align the large flange bolt receptacles 9, provided in the split shaft halves 3, with the corresponding threaded wing head bolt receptacles 19, located in the split reel halves 16. The wing head bolts 8 are then extended through the large flange bolt receptacles 9 and threadably seated in the corresponding internally-threaded wing head bolt receptacles 19, to temporarily lock the split reel 15 on the split shaft fitting 2. The engine in the all terrain vehicle 25 is then started and the drive axle 26 is rotated in reverse, in the direction of the arrow as illustrated in FIG. 1, by operation of the differential 28. This action causes the winch line 22 to wind and accumulate in the winch line groove 20 of the split reel 15 and slowly remove the all terrain vehicle 25 from the mud 29.

It will be appreciated by those skilled in the art that the auxiliary winch 1 of this invention may be designed to permanently mount on the drive axle 26 of the all terrain vehicle 25 without the necessity of splitting the split shaft fitting 2 and the split take-up reel 15. Accordingly, a one-piece shaft fitting 2 and reel 15 can be premounted on the drive axle 26 of the all terrain vehicle 25 before assembling the all terrain vehicle 25, as desired. Furthermore, while the split shaft fitting 2, either as illustrated in the drawing or in its non-split counterpart, can be welded or otherwise attached to the drive axle 26, according to the knowledge of those skilled in the art, it is preferably removably attached by use of the allen bolts 7. It will be further appreciated by those skilled in the art that the winch line 22 may be characterized by steel cable, nylon rope or strapping or polypropylene line, as desired, depending upon the weight of the all terrain vehicle 25, according to the knowledge of those skilled in the art.

It will be further understood that under circumstances where the all terrain vehicle 25 is characterized by four-wheel drive, a separate auxiliary winch 1 can be mounted on each drive axle 26, if so desired, for convenient deployment of the respective winch line 22 either forwardly or rearwardly of the all terrain vehicle 25 to a stump 30 or other fixed object. Moreover, the winch line 22 can be wound in either direction on the split reel 15 before insertion of the wing head bolts 8, in order to effect rotation of the drive axle 26 and rear tires 27 in the desired direction of pull, as illustrated in FIG. 1.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An auxiliary winch for an all terrain vehicle having at least one drive axle, said auxiliary winch comprising a split shaft fitting characterized by a pair of split shaft halves, each having a matching split shaft neck, a matching large flange provided on one end of said split shaft neck and a matching small flange provided on the opposite side of said split shaft neck, said split shaft halves carried by the drive axle in releasable, frictionally-engaging relationship; a split reel characterized by a pair of matching split reel halves provided with a winch line groove, said split reel halves seated on said split shaft neck between said large flange and said small flange in interlocking, normally rotatable relationship; a winch line adapted for winding in said winch line groove with one end of said winch line attached to said split reel; and coupling means adapted for engaging at least one of said split reel halves and said split shaft halves and selectively joining said split reel to said split shaft fitting, whereby said split shaft fitting rotates with respect to said split reel with the drive axle when said coupling means is detached from said split reel and said split shaft fitting, and said split reel rotates with said split shaft fitting and the drive axle when said coupling means engages said split reel and said split shaft fitting, to wind said winch line on said split reel responsive to rotation of the drive axle.

2. The auxiliary winch of claim 1 wherein said coupling means further comprises at least one coupling bolt, at least one first coupling bolt receptacle provided in said split shaft fitting and at least one threaded coupling bolt receptacle provided in said split reel, said threaded coupling bolt receptacle adapted for alignment with said first coupling bolt receptacle for receiving said coupling bolt in said first coupling bolt receptacle and in threadable relationship in said threaded coupling bolt receptacle and coupling said split reel to said split shaft fitting.

3. The auxiliary winch of claim 2 further comprising:

(a) a pulley carried by the vehicle above and substantially in alignment with said split reel for receiving said winch line;

(b) an anchor port provided in said split reel for anchoring one end of said winch line to said split reel; and (c) fitting bolt receptacles provided in said split shaft fitting and fitting bolts threadably engaging said fitting bolt receptacles for assembling said split shaft fitting on the drive axle, and split reel receptacles provided in said split reel and split reel bolts threadably engaging said split reel receptacles for assembling said split reel on said split shaft fitting.

4. The auxiliary winch of claim 3 wherein said at least one coupling bolt further comprises a pair of wing head bolts, said at least one coupling bolt receptacle further comprises a pair of coupling bolt receptacles disposed in spaced relationship in said split shaft fitting and said at least one threaded coupling bolt receptacle further comprises a pair of threaded coupling bolt receptacles disposed in spaced relationship in said split reel for receiving said wing head bolts, respectively.

5. The auxiliary winch of claim 1 further comprising a pulley carried by the vehicle above and substantially in alignment with said split reel for receiving said winch line.

6. The auxiliary winch of claim 5 further comprising fitting bolt receptacles provided in said split shaft fitting and fitting bolts threadably engaging said fitting bolt receptacles for assembling said split shaft fitting on the drive axle, and split reel receptacles provided in said split reel and split reel bolts threadably engaging said split reel receptacles for assembling said split reel on said split shaft fitting.

* * * * *